US005469621A

United States Patent [19]

Alsept et al.

[11] Patent Number: 5,469,621

[45] Date of Patent: Nov. 28, 1995

[54] SEFETY RAZORS WITH A REDUCED SIZED HEAD AND BLADES

[76] Inventors: Mark A. Alsept; Jerry D. Alsept, both of 3434 Wright Rd., Leslie, Mich. 49251

[21] Appl. No.: 187,147

[22] Filed: Jan. 27, 1994

[51] Int. Cl.[6] ..... B26B 21/06

[52] U.S. Cl. ..... 30/50; 30/84

[58] Field of Search ..... 30/85, 50, 29.5, 30/84, 51

[56] References Cited

U.S. PATENT DOCUMENTS 3,786,563 1/1974 Dorion, Jr. et al. ..... 30/85 X
4,282,650 8/1981 Trotta ..... 30/85 X
4,422,237 12/1983 Trotta ..... 30/85
4,599,793 7/1986 Iten ..... 30/85 X
4,939,840 7/1990 Butka ..... 30/50 X

*Primary Examiner*—Rinaldi I. Rada

[57] ABSTRACT

A safety razor with reduced sized head and blades comprising a head formed of a lower portion having a base plate with apertures extending therethrough and a forward end provided with a cleaning groove and rearward end formed with a downwardly extending extent forming the upper portion of the handle, at least one blade secured between the base plate and cap extending forwardly thereof over the cleaning groove, a handle having a gripping portion at its lower extent and coupled at its upper extent to the lower extent of the head and the width of the head being between about 20 and 30 percent of the length of the razor including handle and head.

1 Claim, 3 Drawing Sheets

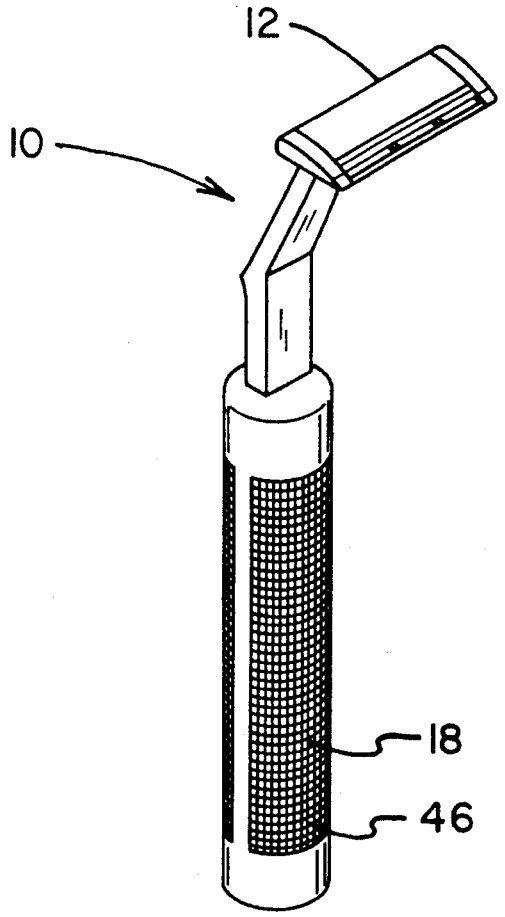
FIG. 1
FIG. 2
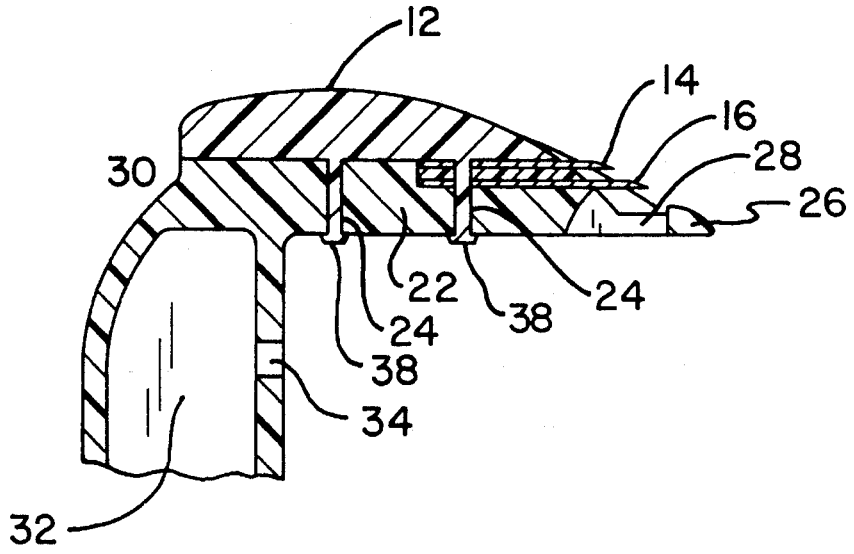

FIG. 5
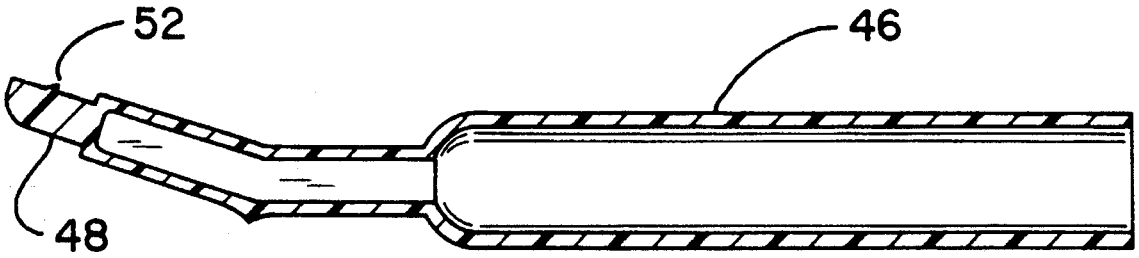
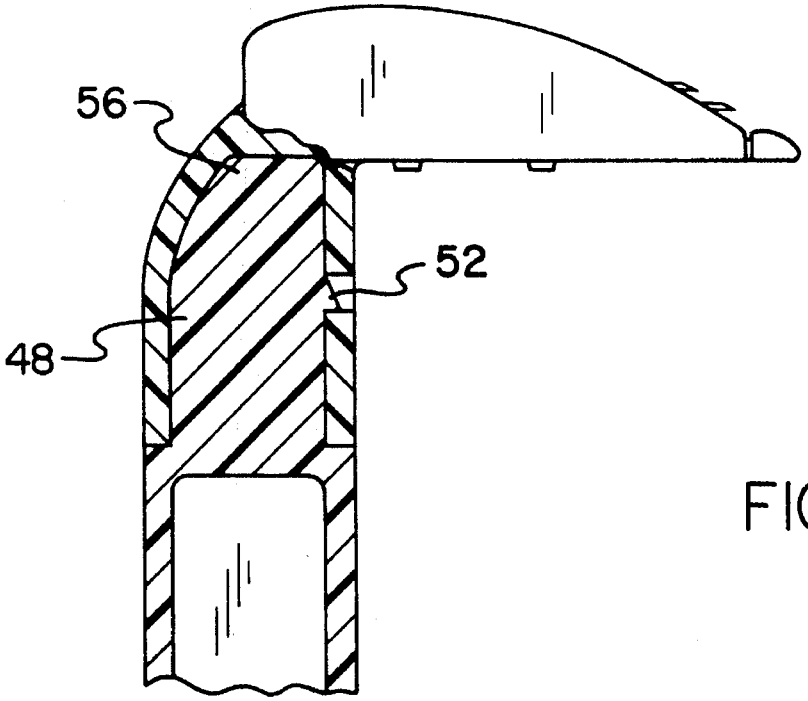
FIG. 6

SEFETY RAZORS WITH A REDUCED SIZED HEAD AND BLADES

BACKGROUND OF THE INVENTION

1. Field of the Invention

The present invention relates to safety razors with a reduced sized head and blades and more particularly pertains to reducing the width of the head and blade of the safety razor for improved shaves.

2. Description of the Prior Art

The use of safety razors is known in the prior art. More specifically, safety razors heretofore devised and utilized for the purpose of for shaving unwanted hairs are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,464,835 a disposable razor including a blade cover and a blade support, said cover making a permanent interlocking connection with the blade support while being movable to and fro relative to the blade support from a storage position to a shaving position having structure for (1) blocking inadvertent movement of the cover out of the storage position and (2) enhancing the integrity of the interlocking connection.

U.S. Pat. No. 4,665,615 discloses a disposable blade carriage for straight razors that have a holder member and a guard member pivotably mounted on each other.

U.S. Pat. No. 4,912,846 discloses a safety razor blade body with a substantially planar upper surface. A row of blunt convex protrusions are spaced along the forward edge portion of the blade body in a comb-like configuration.

U.S. Pat. No. 5,033,191 discloses a relatively inexpensive, disposable and foldable razor comprising a single, die-cut sheet of material that includes a series of unique folds which define a handle portion, a blade holding portion and blade supporting portion which receives and holds a blade in a stationary position during use.

In this respect, the safety razor with a reduced sized head and blades according to the present invention substantially departs from the conventional concepts and designs of the prior art, and in doing so provides an apparatus primarily developed for the purpose of reducing the width of the head and blade of the safety razor for improved shaves.

Therefore, it can be appreciated that there exists a continuing need for a new and improved safety razor with a reduced sized head and blades which can be used for reducing the width of the head and blade of the safety razor for improved shaves. In this regard, the present invention substantially fulfills this need.

SUMMARY OF THE INVENTION

In view of the foregoing disadvantages inherent in the known types of safety razors now present in the prior art, the present invention provides an improved safety razor with a reduced sized head and blades. As such, the general purpose of the present invention, which will be described subsequently in greater detail, is to provide a new and improved safety razor with a reduced sized head and blades and method which has all the advantages of the prior art and none of the disadvantages.

To attain this, the present invention essentially comprises a safety razor with a reduced sized head and blades comprising a head formed of a lower portion having a base plate with apertures extending therethrough and a forward end provided with a cleaning groove and rearward end formed with a downwardly extending recess, the recess having a laterally extending hole therethrough, the head also including a cap with circular rivets extending downwardly therefrom, the rivets being positioned through the apertures of the base plate and heat riveted therewith, a pair of blades secured between the base plate and cap with the cutting edges extending forwardly thereof over the cleaning groove, the blades having apertures for being received by the circular rivets for holding the blades in place, the head also including a spacer plate between the blades for dual blade shaving, a handle having a gripping portion at its lower extent and a coupling portion at its upper extent, the coupling portion including a projection adapted to be positioned through the hole when the upper end of the handle is located within the recess, the width of the head being about twenty-four millimeters from edge to edge.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety razor with a reduced sized head and blades which have all the advantages of the prior art safety razors and none of the disadvantages.

It is another object of the present invention to provide a new and improved safety razor with a reduced sized head and blades which may be easily and efficiently manufactured and marketed.

It is further object of the present invention to provide a new and improved safety razor with a reduced sized head and blades which are of durable and reliable constructions.

An even further object of the present invention is to provide a new and improved safety razor with a reduced sized head and blades which are susceptible of a low cost of manufacture with regard to both materials and labor, and which accordingly are then susceptible of low prices of sale to the consuming public, thereby making such safety razor with a reduced sized head and blades economically available to the buying public.

Still yet another object of the present invention is to provide a new and improved safety razor with a reduced sized head and blades which provide in the apparatuses and methods of the prior art some of the advantages thereof, while simultaneously overcoming some of the disadvantages normally associated therewith.

Still another object of the present invention is to reducing the width of the head and blade of the safety razor for improved shaves.

Lastly, it is an object of the present invention to provide a new and improved a safety razor with reduced sized head and blades comprising a head formed of a lower portion having a base plate with apertures extending therethrough and a forward end provided with a cleaning groove and rearward end formed with a downwardly extending extent forming the upper portion of the handle, at least one blade secured between the base plate and cap extending forwardly thereof over the cleaning groove and a handle having a gripping portion at its lower extent and coupled at its upper extent to the lower extent of the head and the width of the head being between about 20 and 30 percent of the length of the razor including handle and head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the new and improved safety razor with a reduced sized head and blades constructed in accordance with the principles of the present invention.

FIG. 2 is a cross-sectional view longitudinally through the center of the head of the razor of the prior figure.

FIG. 5 is a cross-sectional view of the handle of the razor shown in FIG. 1.

FIG. 6 is a cross-sectional view showing the coupling of the head and handle of the razor of FIG. 1.

The same reference numerals refer to the same parts through the various Figures.

DESCRIPTION OF THE PREFERRED EMBODIMENT

Figure 3:
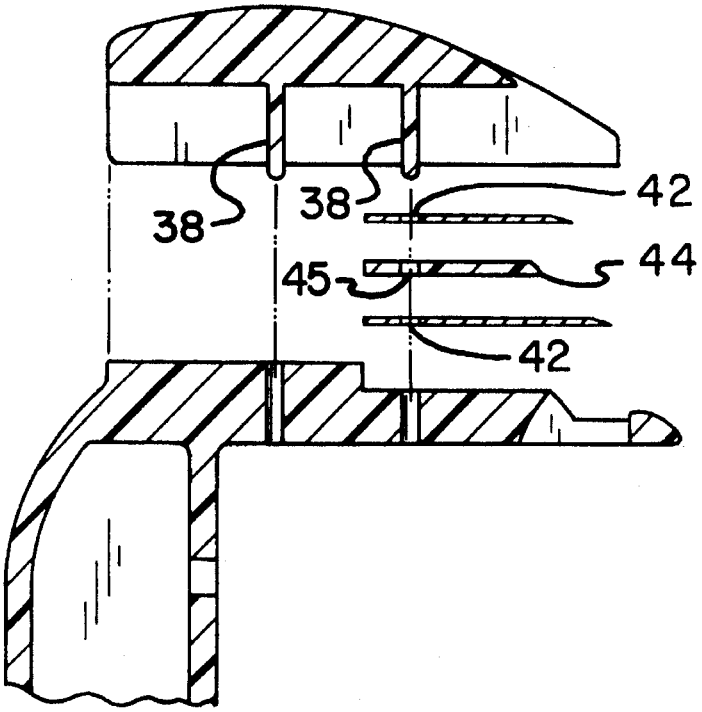
FIG. 3 is a side elevational view of the razor head of FIG. 2 with its parts exploded to show internal construction.
Figure 4:
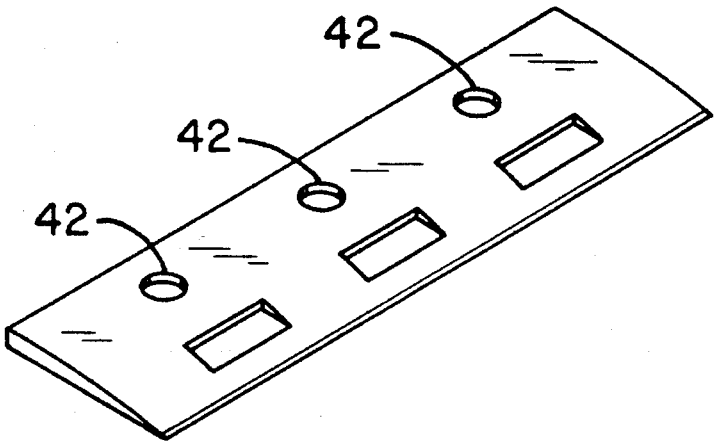
FIG. 4 is a perspective view of one of the blades shown in FIG. 3.

With reference now to the drawings, and in particular to FIG. 1 thereof, the preferred embodiment of the new and improved safety razors with a reduced sized head and blades embodying the principles and concepts of the present invention and generally designated by the reference numeral 10 will be described.

Specifically, it will be noted in the various Figures, that the new and improved safety razor with a reduced sized head and blades may be construed as a system 10 comprised of three major components. Such components are the head 12, the blades 14 and 16, and the handle 18. These component parts are individually fabricated and oriented with respect to each other to attain the intended objectives.

More specifically, the head 12 is formed with a lower portion having a base plate 22. The base plate has apertures 24 extending therethrough. It also has a forward end 26. Extending laterally adjacent to the forward end is a cleaning groove 28. This is the shaving end of the head.

At the rearward end 30 of the head 12 there is formed a downwardly extending recess 32. Such recess has a laterally extending hole 34 therethrough. Also included as part of the head 12 is a cap 36. The cap is formed with integral rivets 38 of a circular configuration. Such rivets extend downwardly from the lower surface of the cap. The rivets are plural rivets in a pair of rows and are adapted to be positioned through the apertures of the base plate. After having been positioned therethrough, they are preferably heat-riveted one to another for a secure coupling therebetween.

In the disclosed preferred embodiment, the invention includes a pair of blades 14 and 16. The blades are positioned one above the other with the lower blade 14 extending forwardly of the upper blade 16. They are located between the base plate and cap with the cutting edges thereof extending forwardly to an extent whereby the cutting edges are located over the cleaning groove. Such blades have apertures 42 for being received by the circular rivets. This arrangement holds the blades in place between the base plate and cap. The head also includes a spacer 44 between the blades with axially aligned holes 45. Such spaced blades oriented with respect to each other and with respect to the base plate and cap are the preferred technique for dual blade shaving.

The next major component of the system is the handle 18. The handle has a gripping portion 46 at its lower extent. At an upper extent is a coupling portion 48. The coupling portion includes a projection 52 extending laterally therefrom. Such projection 52 is adapted to be positioned laterally therefrom. Such projection 52 is adapted to be positioned through the hole in the recess of the base plate. Such projection extends through the hole when the upper end 56 of the handle 18 is located within the recess of the base plate.

In the preferred embodiment of the invention, the width of the head is about 24 millimeters from edge to edge, which is slightly less than 1 inch. The width of the blades is essentially the same constituting at least 90 percent of such edge to edge spacing of the head.

The length of the razor from the lower end of the handle to the upper face of the cap is about 4 inches, slightly greater than 100 millimeters. Consequently, it can be seen that the width of the head is between about 20 percent and 30 percent of the height of the razor.

The present invention is a mini razor which enables the user to receive a more precise shave. With the present invention, one can easily trim his beard around the chin area, trim side burns and trim around ears, without cutting unwanted hair.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved safety razor with a reduced sized head and blades comprising, in combination:

a head formed of a lower portion having a base plate with two sets of apertures extending therethrough and a forward end provided with a cleaning groove and rearward end formed with a downwardly extending recess, the recess having a hole therethrough, the head also including a cap with two sets of circular rivets extending downwardly therefrom, both sets of circular rivets being positioned through the apertures of the base plate and heat riveted therewith;

a pair of blades secured between the base plate and cap with the blades having cutting edges extending forwardly thereof over the cleaning groove, the blades having apertures for being received by only one set of the circular rivets for holding the blades in place, the head also including a spacer plate between the blades for dual blade shaving;

a handle having a gripping portion at its lower extent and a coupling portion at its upper extent, the coupling portion including a projection adapted to be positioned through the hole when the upper end of the handle is located within the recess;

the width of the head being about twenty-four millimeters from edge to edge; and the width of the head being not greater than 30 percent of the length of the razor including handle and head.

* * * * *